United States Patent [19]

Krull

[11] 4,068,689

[45] Jan. 17, 1978

[54] TOOL FOR TRANSFERRING POWDERED MATERIAL FROM ONE CONTAINER TO ANOTHER

[76] Inventor: Frank B. Krull, P.O. Box 205B, Ingallston, Menominee, Mich. 49858

[21] Appl. No.: 718,392

[22] Filed: Aug. 27, 1976

[51] Int. Cl.[2] ..... B65B 1/04

[52] U.S. Cl. ..... 141/93; 141/331

[58] Field of Search ..... 141/331–345, 141/392, 93, 98, 97, 390

[56] References Cited

U.S. PATENT DOCUMENTS

| | | | |
|---|---|---|---|
| 1,225,610 | 5/1917 | Garner | 141/331 |
| 2,636,208 | 4/1953 | Leeper | 141/331 |

*Primary Examiner*—Houston S. Bell, Jr.

*Attorney, Agent, or Firm*—Ira Milton Jones & Associates

[57] ABSTRACT

A funnel securable to the uncovered top of a receptacle containing dry pulverized material is provided with an encircling skirt which coacts with the funnel to define a relatively closed zone encompassing the discharge mouth of the funnel. A hole in the skirt near its junction with the funnel enables that zone to be connected with a source of suction, so that upon inversion of the receptacle to which the funnel is secured, an open-topped container placed in said zone beneath the discharge mouth of the funnel can be filled with dry pulverized material from the receptacle without creating an objectionably dusty environment.

6 Claims, 5 Drawing Figures

TOOL FOR TRANSFERRING POWDERED MATERIAL FROM ONE CONTAINER TO ANOTHER

This invention relates to material handling equipment and refers more particularly to a device or tool with which dry finely pulverized material, such as aluminum powder, can be poured into an open-topped container without creating an objectionably dusty environment.

Accordingly, this invention complements and furthers the objectives of the inventions disclosed and claimed in the Krull U.S. Pat. Nos. 3,792,837 and 3,933,340, the latter of which is being reissued.

As in the U.S. Pat. No. 3,933,340, the open-topped container is located in a zone of subatmospheric pressure while it is being filled, but this invention is a significant improvement over the means employed in the U.S. Pat. No. 3,933,340 to accomplish this desired dust-free filling of the container.

The purpose and object of the invention thus can be stated as the provision of a practical tool by which any open-topped container - whether of the type illustrated in the U.S. Pat. No. 3,792,837 or the U.S. Pat. No. 3,933,340 can be quickly filled with dry particulate material, some or all of which is a fine powder, without creating an objectionably dusty environment.

As will be more fully described hereinafter, the invention resides in the provision of a device or tool with which fine pulverized material such as aluminum powder can be transferred into an open-topped container from a receptacle having a cover removably secured to a rim encircling its mouth, without creating an objectionably dusty environment, which tool comprises: a funnel of a size to fit and be securable to the rim of the receptacle after its cover is removed; means at the discharge mouth of the funnel providing a closure that can be opened and closed; wall means attached to the funnel near its large diameter receiving end, forming a skirt around the funnel, said skirt and funnel coacting to define a zone through which must pass the material leaving the receptacle and issuing from the funnel when the connected receptacle and funnel are inverted and the funnel closure is opened; and means whereby a subatmospheric pressure can be maintained in said zone so that upon placement of the open-topped container in said zone beneath the funnel and opening of said closure, the container can be filled without raising a cloud of dust.

With these observations and objectives in mind, the manner in which the invention achieves its purpose will be appreciated from the following description and the accompanying drawing, which exemplify the invention, it being understood that changes may be made in the specific apparatus disclosed herein without departing from the essentials of the invention set forth in the appended claims.

The accompanying drawing illustrates one complete example of the embodiment of the invention constructed according to the best mode so far devised for the practical application of the principles thereof, and in which.

Figure 1:
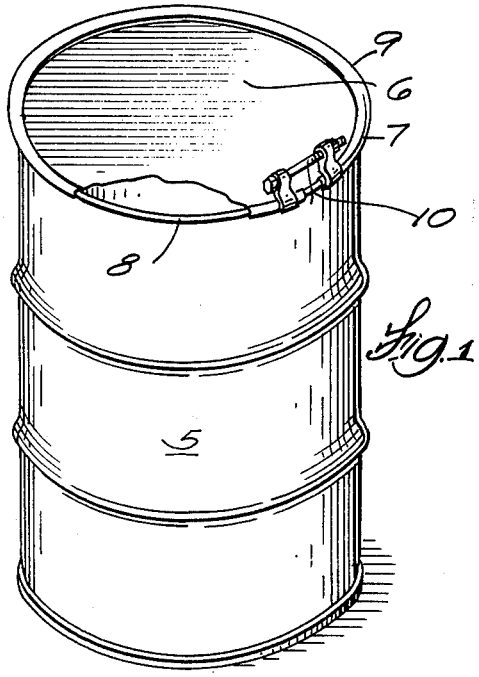
FIG. 1 is a perspective view of a receptacle of the type in which powdered aluminum is shipped by its producer.
Figure 2:
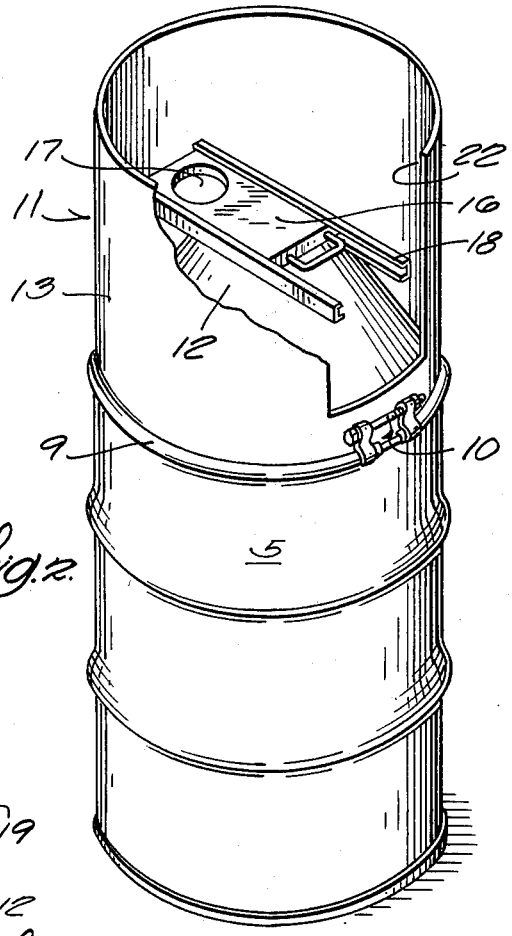
FIG. 2 is a perspective view of the tool of this invention mounted on and secured to the opened top of the receptacle.

Referring to the drawing, the numeral 5 designates a drum or receptacle of the type in which powdered material such as pulverized aluminum is delivered by the manufacturer. Such drums have a removable cover 6 that has a curled edge 7 which fits over a bead 8 around the top edge of the drum. The cover is held in place by a hoop 9 which embraces the curled edge 7 of the cover and the bead 8 and is drawn tightly thereabout by a tensioning bolt 10.

Figure 4:
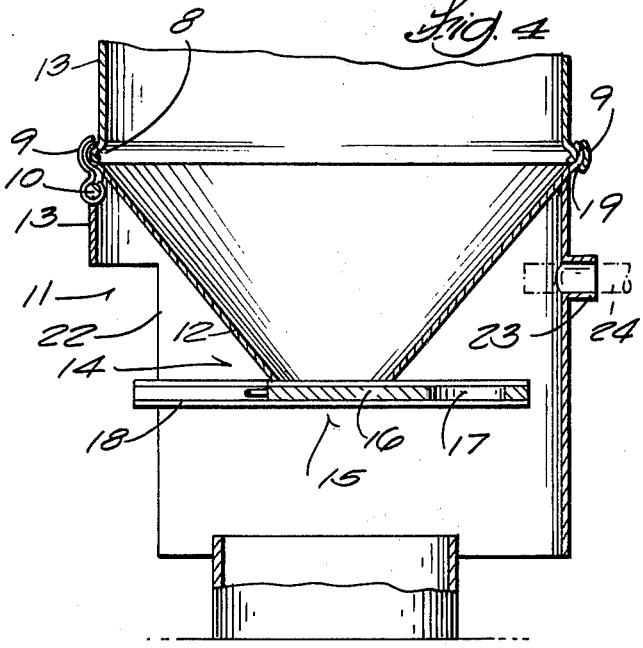
FIG. 4 is a vertical sectional view through FIG. 3 on the plane of the line 4—4.

The tool of this invention, generally designated by the numeral 11, comprises a funnel 12 and a cylindrical skirt 13 suitably secured to the funnel near its large diameter receiving end as by being welded thereto. The skirt encircles the funnel and projects well beyond the discharge end 14 thereof, so that the skirt and funnel coact to define a relatively closed zone encompassing the discharge mouth of the funnel. The discharge mouth is equipped with a controllable closure 15. Preferably this closure is of the sliding gate valve type wherein a plate 16 with a hole 17 is slidable in guideways 18 fixed to the funnel, between a closed position shown in FIG. 4 and an open position in which its hole 17 aligns with the discharge mouth of the funnel.

The tool is securable to the opened top of the drum in the same manner as is the cover of the drum. Thus the large diameter end of the funnel has a curled edge 19 of the same configuration and dimensions as the curled edge 7 of the cover 6. Accordingly, upon removal of the cover, the funnel can be set onto the drum with the curled edge 19 embracing the bead 8 on the drum, and when thus placed can be secured to the drum by means of the hoop 9.

Figure 3:
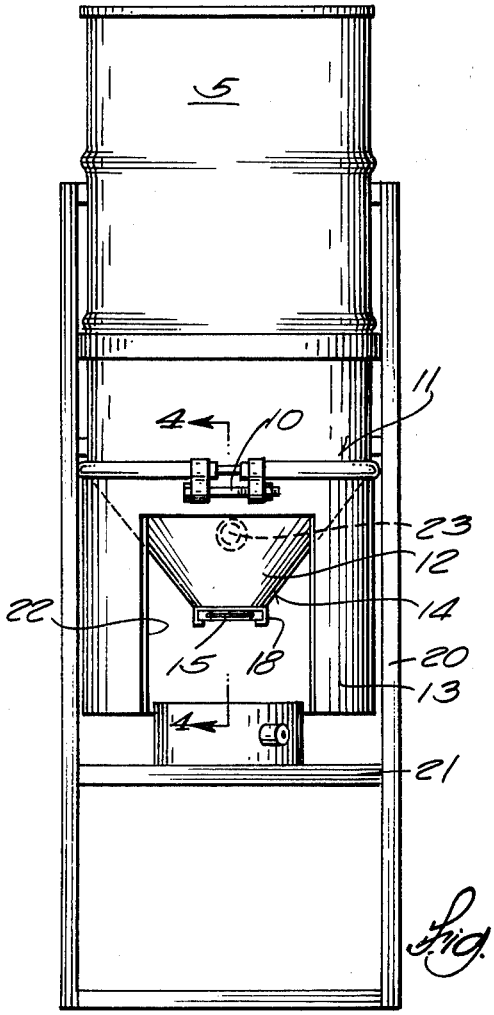
FIG. 3 is a front view of the receptacle with the tool attached thereto, mounted in a frame or stand as it is during the filling of a container.

With the tool secured to the drum and the closure 15 closed, this assembly is inverted and mounted in a stand or frame 20 by which it is supported in an elevated position enabling the open-topped container which is to be filled, to be set under the funnel as shown in FIG. 3. The container illustrated is of the type employed in the invention of the aforesaid Krull U.S. Pat. No. 3,792,837, though it could be like that of the Krull U.S. Pat. No. 3,933,340 patent. In any event, the container is supported on a platform 21 with which the stand or frame 20 is equipped, at an elevation which locates the open top of the container above the bottom edge of the skirt. To facilitate this placement of the container and actuation of the gate valve 16, the skirt has an access opening 22 formed therein.

With the container properly positioned the relatively closed zone between the funnel and the skirt is connected with a source of suction. In this manner, a subatmospheric pressure is maintained in this zone, and since the material flowing from the inverted drum or receptacle into the container when the gate valve 16 is opened drops through this zone of subatmospheric pressure, the container can be filled without creating an objectionably dusty environment.

To facilitate connecting the zone between the skirt and the funnel with a suction source, a port 23 is provided through the wall of the skirt at a location diametrically opposite the access opening 22 and near the junction of the skirt with the funnel. This port may be provided with means to detachably hold the end of a hose 24 that leads to a commercial vacuum cleaner (not shown) or any other suitable source of suction.

Figure 5:
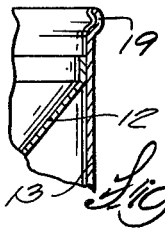
FIG. 5 is a detail sectional view similar to part of FIG. 4, illustrating a modified detail of the invention.

In the embodiment of the invention described above, it is the funnel on which the curled edge 19 is located. Obviously, though, the curled edge could be on the cylindrical skirt as shown in FIG. 5, in which event the funnel is joined to the skirt at a location spaced downwardly from the top of the skirt.

Those skilled in the art will appreciate that the invention can be embodied in forms other than as herein disclosed for purposes of illustration.

The invention is defined by the following claims:

I claim:

1. A tool with which fine pulverized material such as aluminum powder can be transferred into an open-topped container from a receptacle having a cover removably secured to a rim encircling its mouth, without creating an objectionably dusty environment, which comprises:

A. a funnel of a size such that its large receiving end fits and is securable to the rim of the receptacle after its cover is removed;

B. means at the discharge mouth of the funnel providing a closure that can be opened and closed;

C. wall means fixedly secured to the funnel near its receiving end and projecting axially from its securement to the funnel towards and beyond the discharge end of the funnel in increasingly spaced relation to the funnel to form a skirt around the funnel, said skirt and funnel coacting to define a zone through which must pass the material leaving the receptacle and issuing from the funnel when the connected receptacle and funnel are inverted and the closure is opened; and E. means whereby a subatmospheric pressure can be maintained in said zone so that upon placement of the open-topped container in said zone beneath the funnel and opening of said closure, the container can be filled without raising a cloud of dust.

2. The invention defined by claim 1, further characterized by said skirt-forming wall means having an access opening in one side thereof through which access may be had to the closure at the discharge mouth of the funnel, and by which placement and removal of the open-topped container is facilitated.

3. The invention defined by claim 2, wherein said skirt-forming wall means is cylindrical and a cut-out in the end portion thereof remote from its attachment to the funnel provides said access opening.

4. The invention defined by claim 3, wherein the means by which a subatmospheric pressure can be maintained in said zone comprises a hole in said skirt-forming wall means at a location substantially diametrically opposite said cut-out and near the attachment of said wall means to the funnel.

5. The invention defined by claim 1, further characterized by a curled bead adjacent to the receiving end of the funnel to engage over the rim encircling the uncovered mouth of a receptacle preparatory to the funnel being secured to the receptacle.

6. The invention defined by claim 1, wherein said means providing the closure at the mouth of the funnel is a gate valve.

* * * * *

UNITED STATES PATENT OFFICE
CERTIFICATE OF CORRECTION

Patent No. 4,068,689 Dated January 17, 1978

Inventor(s) FRANK B. KRULL

It is certified that error appears in the above-identified patent and that said Letters Patent are hereby corrected as shown below:

The address of the inventor should read as follows:

Frank B. Krull
SR Box 205B
Ingallston, Menominee
Mich. 49858

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*